US007780458B2

(12) United States Patent
Nagata et al.

(10) Patent No.: US 7,780,458 B2
(45) Date of Patent: Aug. 24, 2010

(54) CABLE PLUG ASSEMBLY WITH INTERNAL CIRCUIT BOARD

(75) Inventors: Takayuki Nagata, Yao (JP); Takahisa Ohtsuji, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/126,234

(22) Filed: May 23, 2008

(65) Prior Publication Data

US 2009/0017651 A1 Jan. 15, 2009

(30) Foreign Application Priority Data

Jul. 10, 2007 (JP) ..... 2007-181535

(51) Int. Cl.
*H01R 12/00* (2006.01)

(52) U.S. Cl. ..... 439/76.1; 439/607.58

(58) Field of Classification Search ..... 439/76.1, 439/607.57, 607.54, 607.55, 607.58, 607, 439/578, 394, 607.1, 610
See application file for complete search history.

(56) References Cited

U.S. PATENT DOCUMENTS 4,941,848 A * 7/1990 Philippson et al. ..... 439/607
5,480,327 A * 1/1996 Zola ..... 439/607
6,447,326 B1 * 9/2002 Teach et al. ..... 439/460
6,457,987 B1 * 10/2002 Yeh ..... 439/352
6,524,139 B1 * 2/2003 Chang ..... 439/676
6,617,939 B1 * 9/2003 Vermeersch ..... 333/28 R
6,869,308 B2 * 3/2005 Wu ..... 439/497
7,410,366 B2 * 8/2008 Wu ..... 439/76.1
2001/0044227 A1 * 11/2001 Boutros et al. ..... 439/76.1
2004/0038564 A1 * 2/2004 Yan ..... 439/76.1

FOREIGN PATENT DOCUMENTS

JP 2007-141522 A1 6/2007

* cited by examiner

*Primary Examiner*—Edwin A. Leon
*Assistant Examiner*—Vanessa Girardi
(74) *Attorney, Agent, or Firm*—Kratz, Quintos & Hanson, LLP

(57) ABSTRACT

A cable assembly includes a cable having a plurality of signal lines; a plug portion connectable to a connection target; a circuit board, a first end portion of the circuit board being provided with a plurality of connection portions that are respectively connectable by soldering to the signal lines of the cable, and a second end portion of the circuit board being connectable to the plug portion; and a holder for holding the circuit board. The holder is provided with a plurality of signal line guide grooves for positioning and fixing the signal lines with respect to the connection portions of the circuit board.

9 Claims, 6 Drawing Sheets

(a)

(b)

(a)

(b)

(a)

(b)

CABLE PLUG ASSEMBLY WITH INTERNAL CIRCUIT BOARD

The present application claims priority under 35 U.S.C. §119 of Japanese Patent Application No. 2007-181535 filed on Jul. 10, 2007, the disclosure of which is expressly incorporated by reference herein in its entity.

BACKGROUND OF THE INVENTION

1. Field of the Invention

The present invention relates to a cable assembly for connection with a plurality of signal lines of a cable.

2. Description of the Related Art

In a conventional cable assembly of this type, a plurality of signal lines of a cable are respectively connected by soldering to a plurality of connection pads on a circuit board (see Japanese Patent Application Laid-Open No. 2007-141522).

However, since the signal lines are directly soldered to the connection pads on the circuit board, positioning of the signal lines is difficult and thus workability is poor. Consequently, soldering work for the signal lines and the connection pads may take time and a soldering failure may occur.

Moreover, if the signal lines are thus directly soldered to the connection pads on the circuit board without the signal lines being positioned and fixed, the soldering amounts of soldering portions of the signal lines and the connection pads may become variable. If the soldering amounts of the soldering portions thus become variable, impedance fluctuations occur, adversely affecting electrical characteristics.

Furthermore, since the signal lines are just soldered onto the connection pads, when one of the signal lines is pulled, a break may occur in the corresponding soldering portion.

SUMMARY OF THE INVENTION

The present invention is made in view of the above-described circumstances. An object of the present invention is therefore to provide a cable assembly in which a plurality of signal lines can be easily positioned and fixed in soldering them onto a circuit board.

To solve the above-described problems, a cable assembly of the present invention includes a cable having a plurality of signal lines; a plug portion connectable to a connection target; a circuit board, a first end portion of the circuit board being provided with a plurality of connection portions that are respectively connectable by soldering to the signal lines of the cable, and a second end portion of the circuit board being connectable to the plug portion; and a holder for holding the circuit board, the holder being provided with a plurality of signal line guide grooves for positioning and fixing the signal lines with respect to the connection portions of the circuit board.

In such a cable assembly, the signal line guide grooves of the holder serves to position and fix the respective signal lines with respect to the connection portions of the circuit board. Therefore, soldering workability is improved in soldering the signal lines to the connection portions. Accordingly, the time required for soldering work can be reduced and the probability of a soldering failure can be reduced. Another advantageous effect is that, since the signal lines being already positioned and fixed are soldered to the associated connection portions, it is possible to quantify the amount of solder to be used for soldering between the signal lines and the connection portions, resulting in prevention of impedance fluctuations. Furthermore, since the signal lines are respectively positioned and fixed by the signal line guide grooves, even when one of the signal lines is pulled, the pulling tension will be not directly applied to the corresponding soldering portion. This configuration also contributes to reduced disconnections in the soldering portions. In addition, even if the plug portion connected to the second end of the circuit board is twisted during connecting action to the connection target, because of the circuit board being held by the holder, it is possible to prevent a load resulting from this twisting force from being directly applied to the soldering portions between the connection portions and the signal lines on the circuit board. This configuration also contributes to reduced disconnections in the soldering portions.

It is preferable that the holder be configured to allow the circuit board to be removabaly attached thereto. More particularly, after the circuit board are attached to the holder, the signal lines may be fit into the signal line guide grooves of the holder and soldered to the associated connection portions on the circuit board. In this configuration, it is easy to perform work steps starting from mounting of the circuit board until soldering of the signal lines.

It is preferable that the connection portions be pads arranged in a line on the circuit board. The plurality of signal lines can be soldered to the connection portions thus arranged in a line on the circuit board and can thereby be surface mounted. Accordingly, quantification of the amount of solder to be used for the soldering portions can be further achieved. The connection portions arranged in a line will facilitate control of electrical lengths and impedance among lines from the respective pads provided on the circuit board to an IC.

The holder may have a substantially U-shaped holder main body. The holder main body may have a pair of board holding portions and a signal line holding portion, the signal line holding portion being interposed between first lengthwise end portions of the pair of board holding portions. Inner surfaces of the pair of board holding portions may be provided with a pair of board guide grooves for guiding opposite widthwise end portions of the circuit board toward the signal line holding portion. The plurality of signal line guide grooves are provided at locations of the signal line holding portion that correspond to the plurality of connection portions of the circuit board guided by the board guide grooves of the pair of board holding portions. In this case, when both opposite end portions of the circuit board are guided by the board guide grooves of the pair of board holding portions toward the signal line holding portion, the plurality of connection portions on a first end side of the circuit board are aligned with the plurality of signal line guide grooves of the holder. That is, the above configuration will ease alignment of the plurality of connection portions of the circuit board with the plurality of signal line guide grooves of the holder.

It is preferable that the holder main body further have a placing portion, the placing portion extending from the signal line holding portion in an opposite direction of the pair of board holding portions and allowing the signal lines guided by the signal line guide grooves to be placed thereon. In this case, the signal lines can be fixed all at once by a resin adhesive such as hot melt adhesive, in a state that the plurality of signal lines guided by the plurality of signal line guide grooves are placed on the placing portion. Therefore, the signal lines can be easily fixed. In addition, if the cable is pulled, by bonding the signal lines to the placing portion with a resin adhesive such as hot melt adhesive, it is possible to prevent breaks from occurring in the soldering portions of the signal lines of the cable and the connection portions of the circuit board.

In a case where the plug portion has an engaging projection or an engaging recess, the holder may further have a substantially inverted U-shaped engaging portion provided at a substantially right angle to second lengthwise end portions of the pair of board holding portions of the holder main body. The engaging portion may an engaging recess or an engaging projection for engagement with the engaging projection or the engaging recess of the plug portion with the circuit board being fitted in the board guide grooves of the pair of board holding portions. Namely, in a state that the circuit board being fitted into the board guide grooves of the pair of board holding portions, the plug portion is engaged in the engaging portion and secured in position. Even if the plug portion connected to the second end portion of the circuit board is twisted during connection action to the connection target, because of the circuit board being held by the holder, it is possible to prevent a load resulting from this twisting force from being directly applied to the soldering portions between the plurality of connection portions and the plurality of signal lines on the circuit board. This configuration also contributes to reduced disconnections in the soldering portions.

The cable assembly may further include shielding means for covering all around a rear end portion of the plug portion, the circuit board, and the holder, excluding a front end portion of the plug portion and an area for leading out the cable, the shielding means being adapted to restrict movement of the plug portion, the circuit board, and the holder.

The engaging portion may be configured to have: a pair of column portions respectively provided on first widthwise end surfaces of the pair of board holding portions of the holder main body; and a beam portion suspended across the column portions. In this case, the shielding means may have: a first shield plate that is in contact with second widthwise end surfaces of the pair of board holding portions of the holder main body; a second shield plate that is in contact with the beam portion of the engaging portion and faces the first shield plate with the circuit board and the holder therebetween; a substantially U-shaped third shield plate that is in contact with first widthwise ends of the first and second shield plates and is also in contact with one of the board holding portions of the holder main body and one of the column portions of the engaging portion; a substantially U-shaped fourth shield plate that is in contact with second widthwise ends of the first and second shield plates and is also in contact with other one of the board holding portions of the holder main body and other one of the column portions of the engaging portion; and a holding shield member of a rectangular cylindrical shape with a bottom portion, the holding shield member being configured to cover and hold first lengthwise end portions of the first, second, third, and fourth shield plates and to contact with a first lengthwise end portion of the holder. The front end of the plug portion may be exposed from space formed by second lengthwise end portions of the first, second, third, and fourth shield plates, and the bottom portion of the holding shield member may have a leading-out portion for leading out the cable.

More specifically, the first shield plate contacts second widthwise end surfaces of the pair of board holding portions to cover the rear end portion of the plug portion, the holder, and the circuit board from a second end side in a thickness direction of the circuit board. The second shield plate contacts the beam portion of the engaging portion to covers the rear end of the plug portion, the holder, and the circuit board from a first end side in the thickness direction of the circuit board. The substantially U-shaped third shield plate contacts the first widthwise ends of the first and second shield plates and also contacts one of the board holding portions of the holder main body and one of the column portions of the engaging portion to cover the rear end of the plug portion, the holder, and the circuit board from a first widthwise end side of the circuit board. The substantially U-shaped fourth shield plate contacts the second widthwise ends of the first and second shield plates and contacts the other one of the board holding portions of the holder main body and the other one of the column portions of the engaging portion to cover the rear end of the plug portion, the holder, and the circuit board from a second widthwise end side of the circuit board. Furthermore, the holding shield member covers the first lengthwise end portions of the first, second, third, and fourth shield plates and contacts the first lengthwise end of the holder to cover the rear end of the plug portion, the holder, and the circuit board from the first lengthwise end side of the circuit board. In this way, the rear end of the plug portion, the holder, and the circuit board are covered all around in a state that the front end portion of the plug portion is exposed to the outside and the cable is led outside. In addition, movement of the holder, the circuit board, and the plug portion is restrained because the first, second, third, and fourth shield plates and the holding shield member abut the holder. Thus, even when the plug portion is twisted during connection action to the connection target, it is possible to prevent a load resulting from this twisting force from being directly applied to the soldering portions of the plurality of connection portions and the plurality of signal lines on the circuit board. This configuration also contributes to reduced disconnections in the soldering portions.

The holding shield member may have: a rectangular cylindrical box portion for covering the first lengthwise end portions of the first, second, third, and fourth shield plates; and four closing plates that are bent at a substantially right angle from four sides of a first lengthwise end of the box portion in such a manner to form the bottom portion of the holding shield member. Space formed among top portions of the four closing plates may serve as the leading-out portion.

In this case, the bottom portion of the holding shield member is formed by covering the first lengthwise end portions of the first, second, third, and fourth shield plates with the box portion and thereafter bending the four closing plates at a substantially right angle from the four sides of the first lengthwise end of the box portion. Therefore, simply by covering the first lengthwise end portions of the first, second, third, and fourth shield plates with the box portion and bending the four closing plates, the rear end of the plug portion, the holder, and the circuit board can be covered from the first lengthwise end side of the circuit board, and the first, second, third, and fourth shield plates can be fixed. Accordingly, mounting of the shielding means on the holder can be very easily performed.

DESCRIPTION OF THE PREFERRED EMBODIMENTS

A cable assembly according to an embodiment of the present invention will be described below with reference to the drawings.

Figure 1:
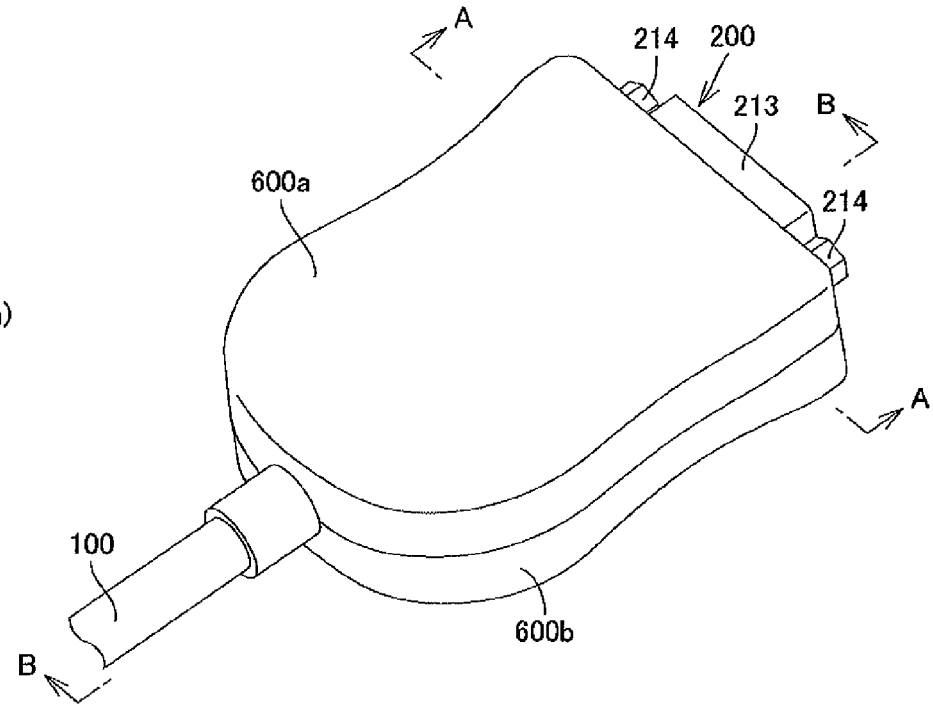
FIG. 1A is a schematic perspective view of a cable assembly according to an embodiment of the present invention.
FIG. 1B a schematic perspective view showing the cable assembly with its upper case being removed.
Figure 1:
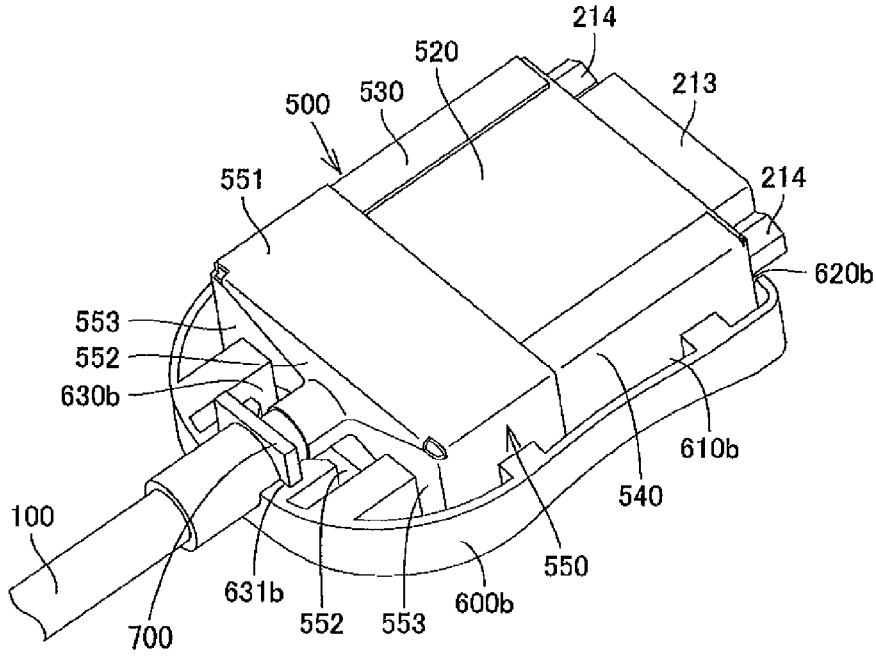

The cable assembly shown in FIGS. 1(*a*), 1(*b*), 2(*a*), and 2(*b*) includes a cable 100 having a plurality of signal lines 110; a plug portion 200 that can be connected to a connection target (e.g., a receptacle of a main body of a personal computer) which is not shown; a circuit board 300 having at a first end in a length direction thereof a plurality of connection portions 310 to which the plurality of signal lines 110 of the cable 100 are respectively connected by soldering, and having the plug portion 200 electrically and mechanically connected thereto at a second lengthwise end portion thereof; a holder 400 that removably holds the circuit board 300; a shielding means 500 that covers all around a rear end of the plug portion 200, the circuit board 300, and the holder 400, excluding an exposed portion of a front end of the plug portion 200 and a leading-out portion of the cable 100, and regulates movement of the plug portion 200, the circuit board 300, and the holder 400; and an upper case 600*a* and a lower case 600*b* that accommodate the plug portion 200, the circuit board 300, the holder 400, and the shielding means 500. Each portion will be described in detail below.

As shown in FIGS. 1(*a*), 1(*b*), 2(*b*), and 3(*a*), the cable 100 is a bulk cable and has the plurality of signal lines 110 incorporated inside an outer insulating layer thereof. Each signal line 110 has an insulating layer and a core 111 which is covered by the insulating layer and connected by soldering to a corresponding connection portion 310 on the circuit board 300.

Figure 3:
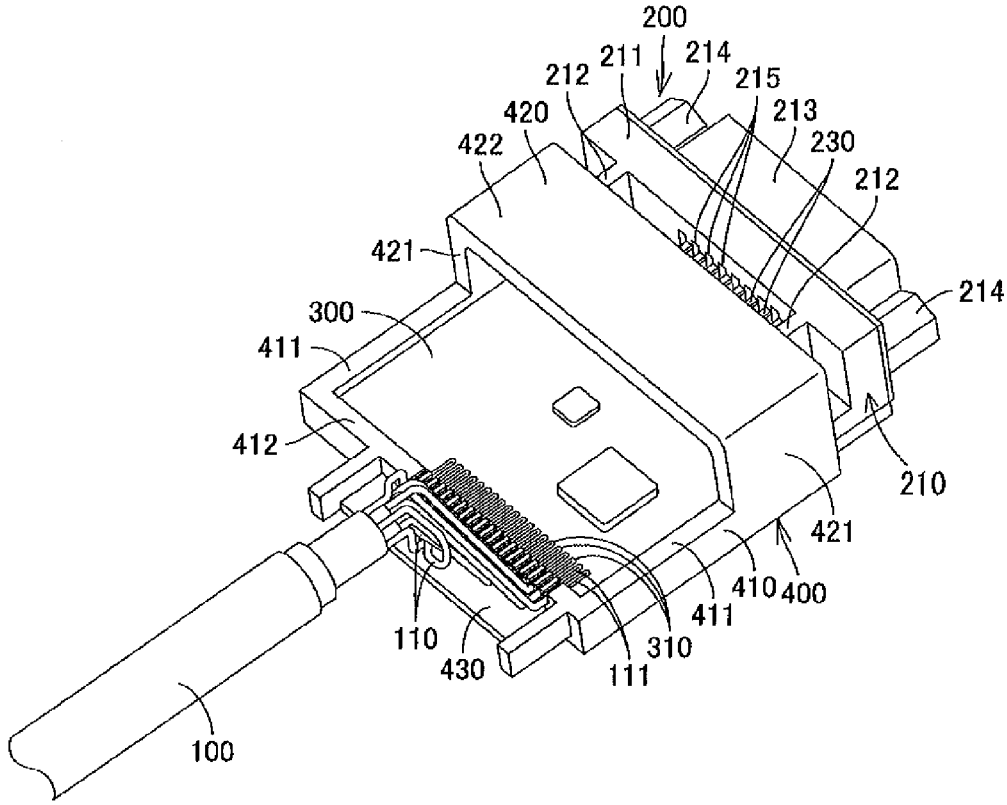
FIG. 3A is a schematic perspective view of the cable assembly with its upper and lower cases and shield means being removed and shows a signal line connected state.
FIG. 3B is a schematic perspective view of the cable assembly with its upper and lower cases and shield means being removed and shows a signal line unconnected state.
Figure 3:
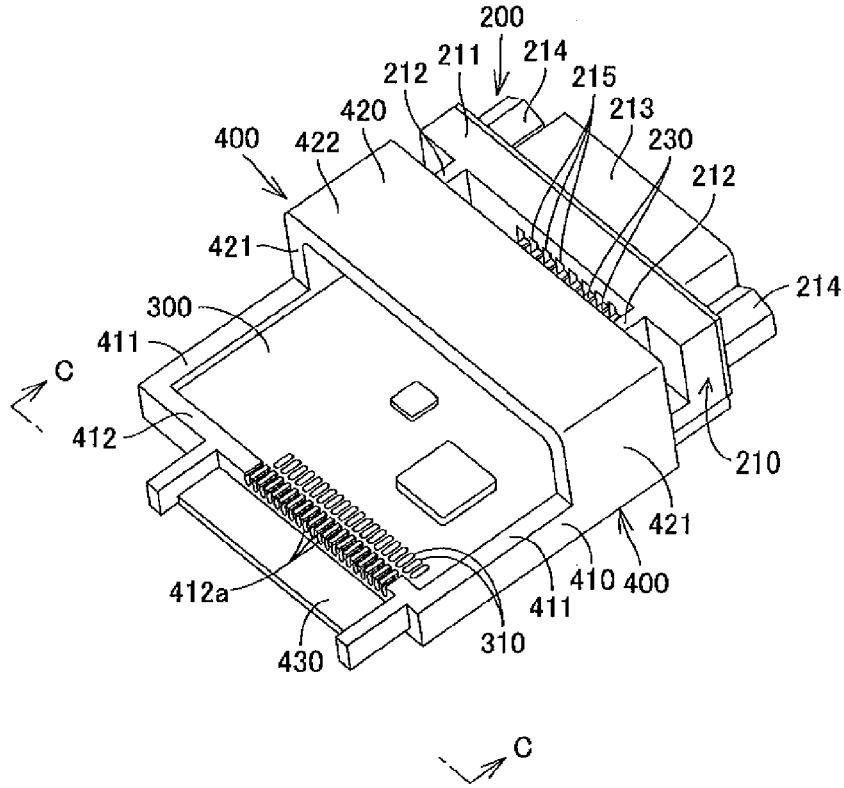

As shown in FIGS. 3(*a*) and 3(*b*), the circuit board 300 is a known printed circuit board and has a reception IC, etc., mounted thereon. The plurality of connection portions 310 (pads) are arranged in a line on the first lengthwise end of the circuit board 300. This in-line arrangement of the plurality of connection portions 310 serves to reduce differences in electrical length among a plurality of lines (not shown) that connect between the reception IC and the plurality of connection portions 310 on the circuit board 300, thereby attempting impedance matching.

As shown in FIGS. 1(*a*) to 5, the plug portion 200 has a plug body 210 and a holding block 220 that are provided on the second lengthwise end of the circuit board 300; and a plurality of contacts 230 held by the plug body 210 and the holding block 220.

The plug body 210 has a rectangular plate portion 211; a pair of plate-like engaging projections 212 provided on a first end surface in a thickness direction of the plate portion 211; a substantially prism-like fitting portion 213 provided on a second end surface in the thickness direction of the plate portion 211; a pair of hexagonal columnar attaching portions 214 provided on opposite sides of the fitting portion 213 on the second end surface of the plate portion 211; and a plurality of contact accommodating holes 215 which penetrate through the plate portion 211 and the fitting portion 213.

The fitting portion 213 fittingly engages with the above-described connection target. The pair of attaching portions 214 has screw holes, into which a pair of attachment screws of the connection target is screwed. The fitting portion 213 and the pair of attaching portions 214 form the front end of the plug portion 200 exposed from the shielding means 500. On the other hand, the plate portion 211, the pair of engaging projections 212, and the holding block 220 form the rear end of the plug portion 200 covered by the shielding means 500.

The pair of engaging projections 212 fits into and is locked in an engaging recess 422*a* of the holder 400.

Figure 2:
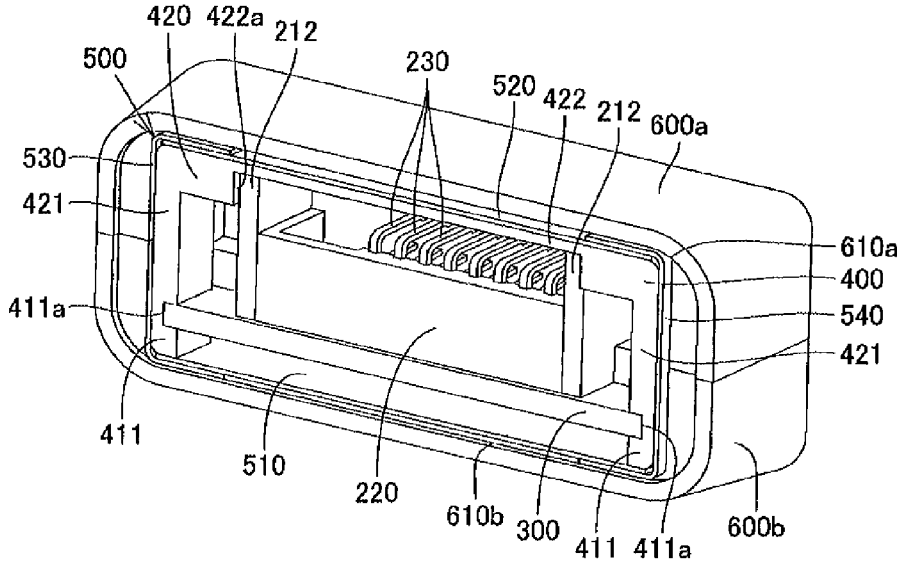
FIG. 2A is a cross-sectional view of the cable assembly taken along line A-A.
FIG. 2B is a cross-sectional view of the cable assembly taken along line B-B.
Figure 2:
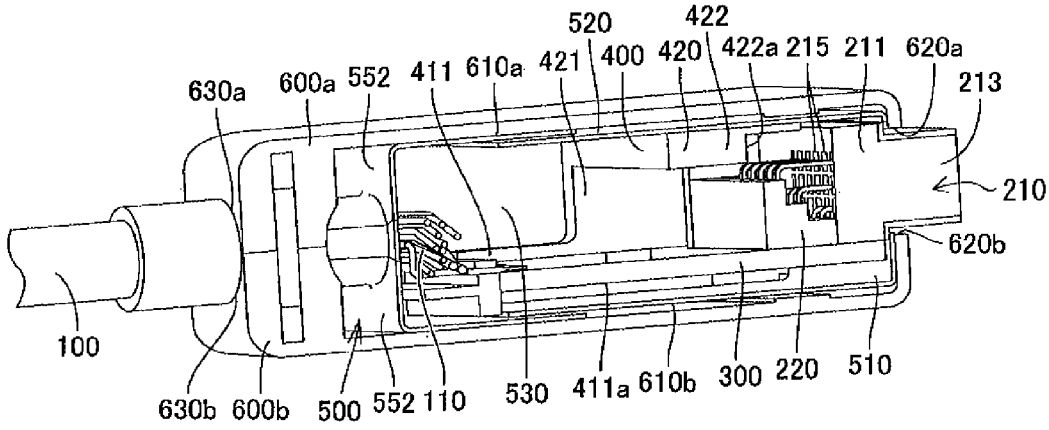

As shown in FIG. 2(*a*), the holding block 220 is located between the pair of engaging projections 212.

The contacts 230 are substantially L-shaped pins. First ends of the contacts 230 are accommodated in corresponding contact accommodating holes 215. Second ends of the contacts 230 are stuck into the holding block 220 and the circuit board 300 and are thereby electrically connected to the circuit board 300.

As shown in FIGS. 3(*a*), 3(*b*), 4(*a*), 4(*b*), 5, 6(*a*), and 6(*b*), the holder 400 has a substantially U-shaped holder main body 410; a substantially inverted U-shaped engaging portion 420 provided at a substantially right angle to second lengthwise ends of a pair of board holding portions 411 of the holder main body 410; and a placing portion 430 extending from a signal line holding portion 412 of the holder main body 410, in the opposite direction of the pair of board holding portions 411.

The holder main body 410 has the pair of board holding portions 411; and the signal line holding portion 412 interposed between first lengthwise ends of the pair of board holding portions 411.

Figure 6:
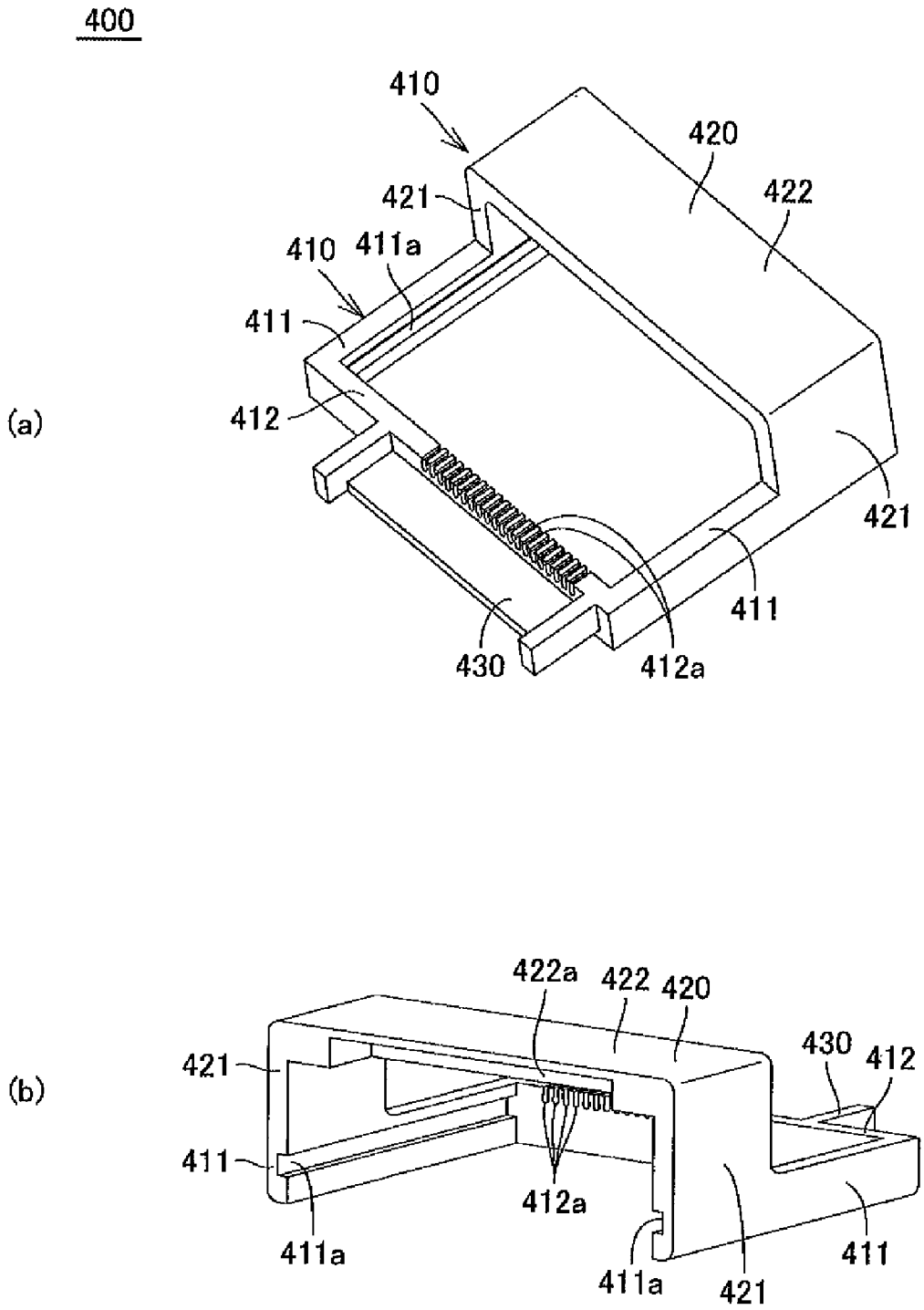
FIG. 6A is a schematic perspective view of the holder of the cable assembly and shows a diagram of the holder as viewed from the upper first end side in a length direction thereof.
FIG. 6B is a schematic perspective view of the holder of the cable assembly and shows the holder as viewed from the upper second end side in the length direction thereof.

As shown in FIGS. 6(*a*) and 6(*b*), a pair of board guide grooves 411*a*, which are long grooves, is provided in inner surfaces of the pair of board holding portions 411 and extends in a length direction of the board holding portions 411. The pair of board guide grooves 411*a* is open at their second lengthwise ends. More particularly, opposite widthwise ends of the circuit board 300 are inserted into the open portions on the second lengthwise end sides of the pair of board guide grooves 411*a* so as to be guided by the board guide grooves 411*a* toward the signal line holding portion 412.

Figure 4:
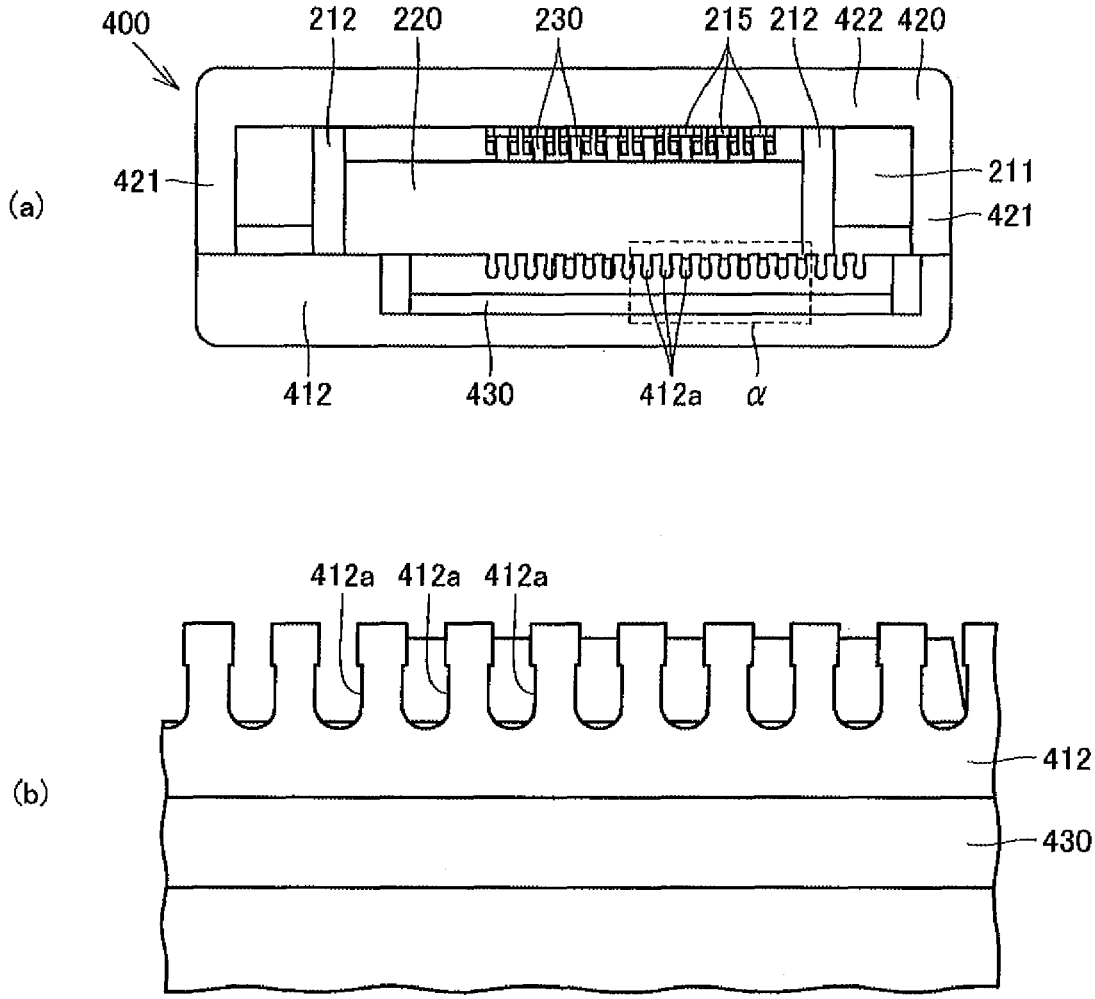
FIG. 4A is a view of the cable assembly with its upper and lower cases and shield means being removed, on arrow C-C.
FIG. 4B is an enlarged view of an a portion.

An upper end of the signal line holding portion 412 is formed with a plurality of signal line guide grooves 412*a* at locations corresponding to the plurality of connection portions 310 on the circuit board 300. As shown in FIGS. 4(*a*) and 4(*b*), each signal line guide groove 412*a* is a substantially U-shaped recess, whose opposite edges project inward. The width between the opposite edges of each signal line guide groove 412*a* is slightly smaller than the width dimension of each signal lines 110. That is, each set of the opposite edges secures each of the signal lines 110 inserted into their corresponding signal line guide grooves 412*a*. This prevents the signal lines 110 from slipping off from the signal line guide grooves 412*a* and prevents a load generated when a signal line 110 is pulled from being directly applied to a soldering portion of a core 111 of the signal line 110 and a connection portion 310, causing a break in the soldering portion.

The placing portion 430 can allow the plurality of signal lines 110 fitted in the plurality of signal line guide grooves 412*a* to be placed thereon. The placing portion 430 functions as a fixing portion where the plurality of signal lines 110 are secured by a resin adhesive such as hot melt adhesive, and functions as a work board on which the plurality of signal lines 110 are placed upon the securing work.

The engaging portion 420 has a pair of plate-like column portions 421; and a plate-like beam portion 422 suspended across the pair of column portions 421. The engaging recess 422*a* is provided in a lower end of the beam portion 422.

Figure 5:
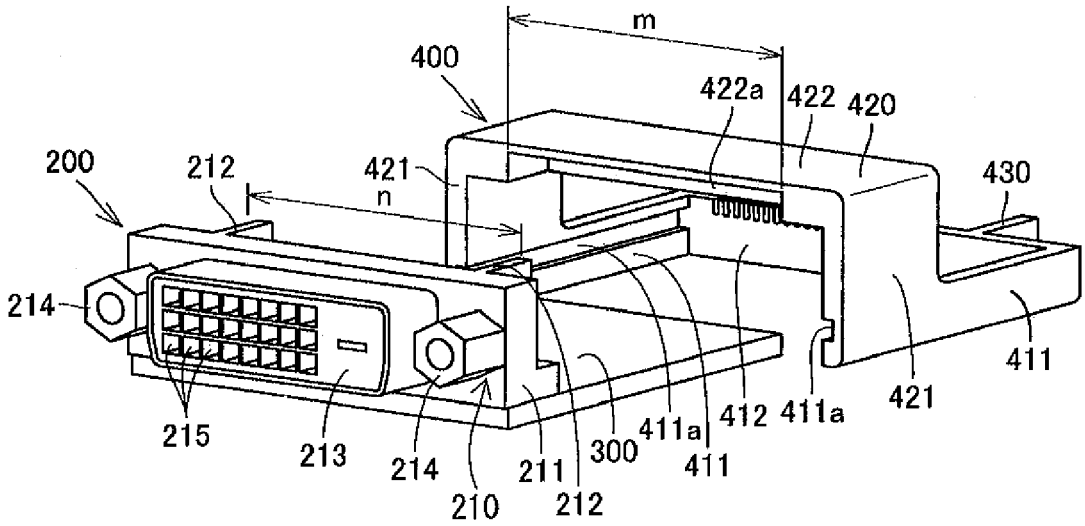
FIG. 5 is a schematic perspective view of the cable assembly before a board and a plug portion are mounted on a holder.

The second end side, in the length direction of the circuit board 300, of the engaging recess 422*a* is open. A length dimension m of the engaging recess 422*a* is slightly larger than a distance n between outer surfaces of the pair of engaging projections 212. As shown in FIG. 5, the pair of engaging projections 212 fits into and is engaged in the engaging recess 422*a* with both widthwise end portions of the circuit board 300 being fitted into the pair of board guide grooves 411*a* of the pair of board holding portions 411. In this manner, the plug portion 200 is positioned and fixed in the engaging recess 422*a* of the engaging portion 420 and movement of the plug portion 200 is regulated from the width direction side of the circuit board 300 and the first end side in the length direction of the circuit board 300.

As shown in FIGS. 1(*b*), 2(*a*), and 2(*b*), the shielding means 500 has a first shield plate 510 that contacts second end surfaces in a width direction of the pair of board holding portions 411 of the holder main body 410 of the holder 400; a second shield plate 520 that contacts the beam portion 422 of the engaging portion 420 of the holder 400; a substantially U-shaped third shield plate 530 that contacts first widthwise end portions of the first and second shield plates 510 and 520 and contacts one of the board holding portions 411 of the holder main body 410 and one of the column portions 421 of the engaging portion 420; a substantially U-shaped fourth shield plate 540 that contacts second widthwise end portions of the first and second shield plates 510 and 520 and contacts the other one of the board holding portions 411 of the holder main body 410 and the other one of the column portions 421 of the engaging portion 420; and a rectangular cylindrical holding shield member 550 with a bottom that covers first ends in a length direction of the first, second, third, and fourth shield plates 510, 520, 530, and 540.

The first shield plate 510 is a rectangular plate-like element whose width is substantially the same as a width (distance between the outer surfaces of the pair of board holding portions 411) of the holder main body 410 of the holder 400. A second lengthwise end portion of the first shield plate 510 is bent in a substantially L-shape along a lower end of the plate portion 211 of the plug portion 200.

The second shield plate 520 is a plate-like element having the same width dimension as the first shield plate 510. A second lengthwise end portion of the second shield plate 520 is also bent in a substantially L-shape along an upper end of the plate portion 211 of the plug portion 200.

The distance between both ends in a width direction of the third shield plate 530 is substantially the same as the sum of a width dimension of the one of the board holding portions 411 of the holder main body 410, a height dimension of the one of the column portions 421 of the engaging portion 420, and thickness dimensions of the first and second shield plates 510 and 520. Accordingly, both widthwise end portions of the third shield plate 530 abut on the first widthwise end portions of the first and second shield plates 510 and 520 mounted on top and bottom surfaces of the holder 400. In this state, an intermediate portion of the third shield plate 530 contacts the one of the board holding portions 411 of the holder main body 410 and the one of the column portions 421 of the engaging portion 420. A second lengthwise end portion of the third shield plate 530 is bent in a substantially L-shape along a first end of the plate portion 211 of the plug portion 200.

The distance between both ends in a width direction of the fourth shield plate 540 is substantially the same as the sum of a width dimension of the other one of the board holding portions 411 of the holder main body 410, a height dimension of the other one of the column portions 421 of the engaging portion 420, and the thickness dimensions of the first and second shield plates 510 and 520. Accordingly, both widthwise end portions of the fourth shield plate 540 abut on the second widthwise end portions of the first and second shield plates 510 and 520 mounted on the top and bottom surfaces of the holder 400. In this state, an intermediate portion of the fourth shield plate 540 contacts the other one of the board holding portions 411 of the holder main body 410 and the other one of the column portions 421 of the engaging portion 420. A second lengthwise end portion of the fourth shield plate 540 is bent in a substantially L-shape along a second end of the plate portion 211 of the plug portion 200.

The fitting portion 213 and the pair of attaching portions 214 of the plug portion 200 are exposed to the outside from the space formed by the substantially L-shaped bent portions of the first, second, third, and fourth shield plates 510, 520, 530, and 540.

The holding shield member 550 has a rectangular cylindrical box portion 551, and a pair of closing plates 552 and a pair of closing plates 553. The box portion 551 covers the first lengthwise end portions of the first, second, third, and fourth shield plates 510, 520, 530, and 540. The pairs of closing plates 552 and 553 are bent at a substantially right angle from four sides of a first lengthwise end of the box portion 551 to form a bottom portion of the holding shield member 550.

Each closing plate 552 is a substantially triangular plate-like element. When bent, the closing plates 552 is in contact with an end surface of the placing portion 430 of the holder 400. The top of each closing plate 552 is provided with a piece portion having an arc shape in cross section.

Each closing plate 553 is a substantially triangular plate-like element. When bent, the closing plates 553 is in contact with the closing plates 552. The top of each closing plate 553 is also provided with a piece portion having an arc shape in cross section.

A cylindrical part consisting of the piece portions of the closing plates 552 and the piece portions of the closing plates 553 serves as a leading-out portion for leading out the cable 100. Also, the piece portions of the closing plates 552 and the piece portions of the closing plates 553 are swaged and fixed to the cable 100 or soldered to the cable 100.

As shown in FIGS. 1(*b*), 2(*a*), and 2(*b*), the lower case 600*b* has an accommodating portion 610*b* that accommodates a lower portion of the shielding means 500 (i.e., a second unit which will be described later) whose components are combined together so as to cover the rear end of the plug portion 200, the circuit board 300 and the holder 400; an opening 620*b* that allows the front end (i.e., the fitting portion 213 and the pair of attaching portions 214) of the plug portion 200 to be exposed to the outside; and a guidepath 630*b* for leading out the cable 100.

The guidepath 630*b* has a recess 631*b* that holds a protective member 700 for protecting the cable 100.

The upper case 600*a*, having the same configuration as the lower case 600*b*, is used in combination with the lower case 600*b*. The upper case 600*a* accommodates an upper portion of the shielding means 500 whose components are combined together so as to cover the rear end of the plug portion 200, the circuit board 300 and the holder 400. Thus, a detailed description is omitted.

The assembling procedure of a cable assembly having such a configuration will be described in detail below. First, both widthwise end portions of the circuit board 300 having the plug portion 200 electrically and mechanically connected thereto at the second lengthwise end portion thereof are inserted into the board guide grooves 411*a* of the pair of board holding portions 411 of the holder 400 from the second end side of the circuit board 300. The inserted widthwise end portions of the circuit board 300 contact the signal line holding portion 412 of the holder 400. As a result, the plurality of connection portions 310 of the circuit board 300 are placed at such locations as to correspond to the plurality of signal line guide grooves 412*a* of the signal line holding portion 412, as shown in FIG. 3(*b*).

At the same time, the pair of engaging projections 212 of the plug portion 200 fits into and is engaged in the engaging recess 422*a* of the holder 400 from the second end side of the circuit board 300.

Thereafter, the plurality of signal lines 110 of the cable 100 are fit into the respective signal line guide grooves 412*a* of the holder 400 so as to be positioned and fixed. In this state, the cores 111 exposed from the insulating layers of the signal lines 110 are respectively connected by soldering to the connection portions 310 on the circuit board 300 (which will serve as soldering portions).

Then, the plurality of signal lines 110 are secured and fixed all at once to the placing portion 430 of the holder 400 by a resin adhesive such as hot melt adhesive. This is how the circuit board 300 and the plug portion 200 are attached to the holder 400 and the plurality of signal lines 110 are connected (hereinafter, referred to as a "first unit").

Thereafter, while the bent portion of the second lengthwise end portion of the first shield plate 510 is hooked to the lower end of the plate portion 211 of the plug portion 200 of the first unit, the first shield plate 510 is brought into contact with the second widthwise end surfaces of the pair of board holding portions 411 of the holder 400 (i.e., a lower face of the holder 400). While the bent portion of the second lengthwise end portion of the second shield plate 520 is hooked to the upper end of the plate portion 211 of the plug portion 200 of the first unit, the second shield plate 520 is brought into contact with the beam portion 422 of the engaging portion 420 of the holder 400 (i.e., an upper face of the holder 400). As a result, the first and second shield plates 510 and 520 face each other.

Then, while the bent portion of the second lengthwise end portion of the third shield plate 530 is hooked to the first end of the plate portion 211 of the plug portion 200 of the first unit, both widthwise end portions of the third shield plate 530 are brought into contact with the first widthwise end portions of the first and second shield plates 510 and 520, respectively. As a result, the intermediate portion of the third shield plate 530 is brought into contact with the one of the board holding portions 411 of the holder main body 410 and the one of the column portions 421 of the engaging portion 420 of the holder 400 (i.e., a side face the holder 400) of the first unit.

Similarly, while the bent portion of the second lengthwise end portion of the fourth shield plate 540 is hooked to the second end of the plate portion 211 of the plug portion 200 of the first unit, both widthwise end portions of the fourth shield plate 540 are brought into contact with the second widthwise end portions of the first and second shield plates 510 and 520. As a result, the intermediate portion of the fourth shield plate 540 is brought into contact with the other one of the board holding portions 411 of the holder main body 410 and the other one of the column portions 421 of the engaging portion 420 of the holder 400 (i.e., the other side face the holder 400) of the first unit.

When the first, second, third, and fourth shield plates 510, 520, 530, and 540 are thus mounted on four surfaces of the first unit, the fitting portion 213 and the pair of attaching portions 214 of the plug portion 200 of the first unit are exposed from the space formed by the bent portions of the second lengthwise end portions of the first, second, third, and fourth shield plates 510, 520, 530, and 540.

In this state, the first unit on which the first, second, third, and fourth shield plates 510, 520, 530, and 540 are mounted is inserted into the holding shield member 550 whose pairs of closing plates 552 and 553 are not yet bent. As a result, the box portion 551 of the holding shield member 550 covers the first lengthwise end portions of the first, second, third, and fourth shield plates 510, 520, 530, and 540.

Thereafter, the pair of closing plates 552 is bent inward at a right angle. In doing so, the pair of closing plates 552 contacts a front end surface of the placing portion 430 of the holder 400 of the first unit. Then, the pair of closing plates 553 is bent inward at a right angle and thereby contacts the pair of closing plates 552. As a result, an opening on the first lengthwise end side of the box portion 551 is closed and the first lengthwise end side of the first unit is covered. Then, the two piece portions of the pair of closing plates 552 and the two piece portions of the pair of closing plates 553 form a cylindrical element that covers the cable 100. That is, the cylindrical element serves as a cylindrical leading-out portion for leading the cable 100 outside the shielding means 500. This is how the shielding means 500 is mounted on the first unit (hereinafter, referred to as a "second unit").

Thereafter, the piece portions of the closing plates 552 and the piece portions of the closing plates 553 are swaged and fixed to the cable 100 or soldered to the cable 100.

Then, a lower end portion of the second unit is accommodated in the accommodating portion 610*b* of the lower case 600*b*. As a result, the fitting portion 213 and the pair of attaching portions 214 of the plug portion 200 of the second unit fit into the opening 620*b* of the lower case 600*b*.

At the same time, the protective member 700 for the cable 100 is fittingly placed into the recess 631*b* of the driving path 630*b* of the lower case 600*h*.

Thereafter, the upper case 600*a* is mounted on the lower case 600*b*. Then, an upper portion of the second unit is accommodated in the accommodating portion 610*a* of the upper case 600*a*. Also, the fitting portion 213 and the pair of attaching portions 214 of the plug portion 200 of the second unit fit into the opening 620*a* of the upper case 600*a*. As a result, the fitting portion 213 and the pair of attaching portions 214 of the plug portion 200 are exposed outside the case from the openings 620*a* and 620*b*.

Along with this, the protective member 700 for the cable 100 is fittingly placed into the recess 631*a* of the driving path 630*a* of the upper case 600*a*. As a result, the protective member 700 and the cable 100 are held by the upper case 600*a* and the lower case 600*b*, and the cable 100 is led out from the guidepaths 630*a* and 630*b*.

In a cable assembly embodied as described above, the plurality of signal line guide grooves 412*a* of the holder 400 serves to position and fix the respective signal lines 110 of the cable 100 with respect to the plurality of connection portions 310 of the circuit board 300. Hence, soldering workability is improved in soldering the plurality of signal lines 110 to the plurality of connection portions 310. Accordingly, the time required for soldering work can be reduced and the probability of a soldering failure can also be reduced.

Another advantageous effect is that, since the signal lines 110 being already positioned and fixed are soldered to the associated connection portions 310, it is possible to quantify the amount of solder to be used for soldering between the plurality of signal lines 110 and the plurality of connection portions 310, resulting in prevention of impedance fluctuations.

The plurality of signal lines 110 are respectively positioned and fixed by the plurality of signal line guide grooves 412*a*. The plurality of signal lines 110 are secured all at once to the placing portion 430 of the holder 400 by a resin adhesive such as hot melt adhesive. Furthermore, the piece portions of the closing plates 552 and the piece portions of the closing plates 553 of the shielding means 500 are swaged and fixed to the cable 100 or soldered to the cable 100. Therefore, even when the cable 100 is pulled, the pulling tension will be not directly applied to the soldering portions of the plurality of signal lines 110 of the cable 100 and the plurality of connection portions 310. This configuration contributes to reduced disconnections in the soldering portions.

Moreover, both widthwise end portions of the circuit board 300 are fitted into the pair of board guide grooves 411*a* of the holder 400. The pair of engaging projections 212 of the plug portion 200 is engaged in the engaging recess 422*a* of the holder 400. Furthermore, the first unit is abutted by the first, second, third, and fourth shield plates 510, 520, 530, and 540 and the holding shield member 550, whereby movement of the first unit is restricted. Therefore, even if the plug portion 200 of the first unit is twisted during connecting action to a connection target, a load resulting from this twisting force is dispersed through the circuit board 300, the holder 400, and the shielding means 500. Hence, it is possible to prevent a load resulting from this twisting force from being directly applied to the soldering portions of the plurality of connection portions 310 on the circuit board 300 and the plurality of signal lines 110. This configuration thus contributes to reduced disconnections in the soldering portions.

Note that any design change can be made to the above-described cable assembly as long as it includes a cable having a plurality of signal lines; a plug portion connectable to a connection target; a circuit board, a first end portion of the circuit board being provided with a plurality of connection portions that are respectively connectable by soldering to the signal lines of the cable, and a second end portion of the circuit board being connectable to the plug portion; and a holder for holding the circuit board, the holder being provided with a plurality of signal line guide grooves for positioning and fixing the signal lines with respect to the connection portions of the circuit board.

The cable 100 is described as a bulk cable in the above embodiment. However, the cable 100 is not limited thereto and any cable can be used as long as the cable has a plurality of signal lines 110.

Any design change can be made to the circuit board 300 as long as its first end is provided with a plurality of connection portions that are respectively connectable by soldering to the plurality of signal lines of the cable while its second end portion is connectable to the plug portion. More specifically, the circuit board 300 is not limited to a one-layer circuit board such as the one described in the above embodiment, but may be a two-layer circuit board, a four-layer circuit board, etc. In the case in which connection portions are provided on both sides of a circuit board, the holder may have a plurality of signal line guide grooves corresponding to the plurality of connection portions on both sides of the circuit board.

The connection portions 310 are not limited to pads arranged in a line on the circuit board 300 as described above. For example, the circuit board may be provided with through-holes or the like adapted to connected by soldering the plurality of signal lines 110.

Any design change can be made to the holder 400 as long as the holder 400 can hold the circuit board and has a plurality of signal line guide grooves for positioning and fixing a plurality of signal lines with respect to a plurality of connection portions of the circuit board. Accordingly, the holder does not need to be configured to allow the circuit board to be removed therefrom and the circuit board may be embedded in the holder or the circuit board may be bonded to the holder with an adhesive or the like.

Any design change can be made to the signal line guide grooves 412*a* as long as the signal line guide grooves 412*a* can allow a plurality of signal lines to be positioned and fixed with respect to a plurality of connection portions of a circuit board.

Whether or not to provide the engaging portion 420 to the holder 400 can be freely decided. Although the engaging portion 420 has the engaging recess 422*a*, instead of this, an engaging projection may be provided. In this case, an engaging recess in which the engaging projection is engaged should be provided to the plug portion 200.

Whether or not to provide the placing portion 430 to the holder 400 can be freely decided. In the case in which the placing portion 430 is not provided, the pair of closing plates 552 of the holding shield member 550 is allowed to abut on first end surfaces in the length direction of the pair of board holding portions 411.

Any design change can be made to the plug portion 200 as long as the plug portion can be connected to a connection target. Although the front end of the plug portion 200 is configured by the fitting portion 213 and the pair of attaching portions 214, the front end can be configured by any as long as the front end can be connected to a connection target. Also, the rear end of the plug portion 200 can be configured by any as long as the rear end can be electrically and mechanically connected to the circuit board. The connection target is not limited to a receptacle of a main body of a personal computer (electronic device) described in the embodiment and can be a receptacle of any other electronic device or other plugs.

The engaging projections 212 can be any form as long as they can be engaged in the engaging recess. The minimum number of the engaging projections is one. Alternatively, the plug portion 200 may be provided with at least one engagement recess, while the engaging portion 420 may be provided with at least one engagement projection for engagement with the engagement recess.

Any design change can be made to the shielding means 500 as long as the shielding means can cover all around a rear end of a plug portion, a circuit board, and a holder, excluding a front end of the plug portion and a leading-out portion of a cable.

For example, by providing the pairs of closing plates 552 and 553 at the first lengthwise end portions of the first, second, third, and fourth shield plates 510, 520, 530, and 540 and bending the closing plates 552 and 553 at a substantially right angle, the first end side in the length direction of the first unit can be covered. Alternatively, the length of the box portion 551 of the holding shield member 550 may be increased to cover all around the first unit only by the holding shield member 550.

The holding shield member 550 can be configured in any manner as long as the holding shield member has the rectangular cylindrical box portion 551 and a plate portion that forms a bottom portion of the holding shield member 550. In this case, a leading-out portion, such as a hole, from which the cable 100 is derived should be provided to the plate portion.

Any design change can be made to the forms of the closing plates 552 and 553 as long as the closing plates have the leading-out portion and can close a bottom portion of the box portion 551.

The leading-out portion can be configured in any manner as long as the driving portion can allow the cable 100 to be derived outside a shielding means. Accordingly, the leading-out portion may be simply a hole or the like.

What is claimed is:

1. A cable plug assembly comprising:

a cable having a plurality of signal lines;

a plug portion connectable to a connection target;

a circuit board, a first end portion of the circuit board being provided with a plurality of connection portions that are respectively connectable by soldering to the signal lines of the cable, and a second end portion of the circuit board being connectable to the plug portion; and a holder for removably holding the circuit board, the holder including a holder main body of a substantially U-shape in plan view, wherein the holder main body has a pair of board holding portions and a signal line holding portion, the signal line holding portion being interposed between first lengthwise end portions of the pair of board holding portions, the holder main body further has a placing portion, the placing portion extending from the signal line holding portion in an opposite direction of the pair of board holding portions, inner surfaces of the pair of board holding portions are provided with a pair of board guide grooves for movably guiding opposite widthwise end portions of the circuit board toward the signal line holding portion, the signal line holding portion faces said first end portion of the circuit board when guided by the board guide grooves, and the signal line holding portion is provided with a plurality of signal line guide grooves for positioning and fixing the signal lines with respect to the connection portions of the circuit board, and the placing portion is provided with an adhesive adhering to the placing portion and the plurality of signal lines which allows the signal lines, guided by the signal line guide grooves, to be adhered to the placing portion.

2. The cable plug assembly according to claim 1, wherein the connection portions comprise pads arranged in a line on the circuit board.

3. The cable plug assembly according to claim 1, further comprising:

shielding means for covering all around a rear end portion of the plug portion, the circuit board, and the holder, excluding a front end portion of the plug portion and an area for leading out the cable, the shielding means being adapted to restrict movement of the plug portion, the circuit board, and the holder.

4. A cable plug assembly comprising:

a cable having a plurality of signal lines;

a plug portion connectable to a connection target;

a circuit board, a first end portion of the circuit board being provided with a plurality of connection portions that are respectively connectable by soldering to the signal lines of the cable, and a second end portion of the circuit board being connectable to the plug portion; and a holder for removably holding the circuit board, wherein the holder has a holder main body of a substantially U-shape in plan view and a substantially inverted U-shaped engaging portion opening downward, the holder main body has a pair of board holding portions and a signal line holding portion, the signal line holding portion being interposed between first lengthwise end portions of the pair of board holding portions, the signal line holding portion has a plurality of signal line guide grooves for positioning and fixing the signal lines with respect to the connection portions of the circuit board, and inner surfaces of the pair of board holding portions are provided with a pair of board guide grooves for movably guiding opposite widthwise end portions of the circuit board toward the signal line holding portion; and the plug portion has an engaging projection or an engaging recess, and the engaging portion is oriented at a substantially right angle to second lengthwise end portions of the pair of board holding portions of the holder main body and has an engaging recess or an engaging projection for engagement with the engaging projection or the engaging recess of the plug portion with the circuit board being fitted in the board guide grooves of the pair of board holding portions.

5. The cable plug assembly according to claim 4, further comprising:

shielding means for covering all around a rear end portion of the plug portion, the circuit board, and the holder, excluding a front end portion of the plug portion and an area for leading out the cable, the shielding means being adapted to restrict movement of the plug portion, the circuit board, and the holder.

6. The cable plug assembly according to claim 5, wherein the engaging portion has:

a pair of column portions respectively provided on first widthwise end surfaces of the pair of board holding portions of the holder main body; and a beam portion suspended across the column portions, the shielding means has:

a first shield plate that is in contact with second widthwise end surfaces of the pair of board holding portions of the holder main body;

a second shield plate that is in contact with the beam portion of the engaging portion and faces the first shield plate with the circuit board and the holder therebetween;

a substantially U-shaped third shield plate that is in contact with first widthwise ends of the first and second shield plates and is also in contact with one of the board holding portions of the holder main body and one of the column portions of the engaging portion;

a substantially U-shaped fourth shield plate that is in contact with second widthwise ends of the first and second shield plates and is also in contact with other one of the board holding portions of the holder main body and other one of the column portions of the engaging portion; and a holding shield member of a rectangular cylindrical shape with a bottom portion, the holding shield member being configured to cover and hold first lengthwise end portions of the first, second, third, and fourth shield plates and to contact with a first lengthwise end portion of the holder, wherein the front end portion of the plug portion is exposed from space formed by the second lengthwise end portions of the first, second, third, and fourth shield plates, and wherein the bottom portion of the holding shield member has a leading-out portion for leading out the cable.

7. The cable plug assembly according to claim 6, wherein the holding shield member has:

a rectangular cylindrical box portion for covering the first lengthwise end portions of the first, second, third, and fourth shield plates; and four closing plates that are bent at a substantially right angle from four sides of a first lengthwise end of the box portion in such a manner to form the bottom portion of the holding shield member, and space formed among top portions of the four closing plates serves as the leading-out portion.

8. A cable plug assembly comprising:

a cable having a plurality of signal lines;

a plug portion connectable to a connection target;

a circuit board, a first end portion of the circuit board being provided with a plurality of connection portions that are respectively connectable by soldering to the signal lines of the cable, and a second end portion of the circuit board being connectable to the plug portion; and a holder for removably holding the circuit board, wherein the holder has a holder main body of a substantially U-shape in plan view and a substantially inverted U-shaped engaging portion opening downward, the holder main body has a pair of board holding portions and a signal line holding portion, the signal line holding portion being interposed between first lengthwise end portions of the pair of board holding portions, the signal line holding portion has a plurality of signal line guide grooves for positioning and fixing the signal lines with respect to the connection portions of the circuit board, and inner surfaces of the pair of board holding portions are provided with a pair of board guide grooves for movably guiding opposite widthwise end portions of the circuit board toward the signal line holding portion; and shielding means for covering all around a rear end portion of the plug portion, the circuit board, and the holder, excluding a front end portion of the plug portion and an area for leading out the cable, the shielding means being adapted to restrict movement of the plug portion, the circuit board, and the holder;

wherein the engaging portion has:

a pair of column portions respectively provided on first widthwise end surfaces of the pair of board holding portions of the holder main body; and a beam portion suspended across the column portions, the shielding means has:

a first shield plate that is in contact with second widthwise end surfaces of the pair of board holding portions of the holder main body;

a second shield plate that is in contact with the beam portion of the engaging portion and faces the first shield plate with the circuit board and the holder therebetween;

a substantially U-shaped third shield plate that is in contact with first widthwise ends of the first and second shield plates and is also in contact with one of the board holding portions of the holder main body and one of the column portions of the engaging portion;

a substantially U-shaped fourth shield plate that is in contact with second widthwise ends of the first and second shield plates and is also in contact with other one of the board holding portions of the holder main body and other one of the column portions of the engaging portion; and a holding shield member of a rectangular cylindrical shape with a bottom portion, the holding shield member being configured to cover and hold first lengthwise end portions of the first, second, third, and fourth shield plates and to contact with a first lengthwise end portion of the holder, wherein the front end portion of the plug portion is exposed from space formed by the second lengthwise end portions of the first, second, third, and fourth shield plates, and wherein the bottom portion of the holding shield member has a leading-out portion for leading out the cable.

9. The cable plug assembly according to claim 8, wherein the holding shield member has:

a rectangular cylindrical box portion for covering the first lengthwise end portions of the first, second, third, and fourth shield plates; and four closing plates that are bent at a substantially right angle from four sides of a first lengthwise end of the box portion in such a manner to form the bottom portion of the holding shield member, and space formed among top portions of the four closing plates serves as the leading-out portion.

* * * * *